US012104864B2

(12) United States Patent
Yu et al.

(10) Patent No.: US 12,104,864 B2
(45) Date of Patent: Oct. 1, 2024

(54) THERMAL METAMATERIALS FOR DIRECTIONAL EMISSION IN HEAT TRANSFER SYSTEMS

(71) Applicant: Toyota Motor Engineering & Manufacturing North America, Inc., Plano, TX (US)

(72) Inventors: Ziqi Yu, Ann Arbor, MI (US); Taehwa Lee, Ann Arbor, MI (US); Ercan Mehmet Dede, Ann Arbor, MI (US); Masaki Nakaoka, Ann Arbor, MI (US)

(73) Assignees: Toyota Motor Engineering & Manufacturing North America, Inc., Plano, TX (US); Toyota Jidosha Kabushiki Kaisha, Toyota (JP)

( * ) Notice: Subject to any disclaimer, the term of this patent is extended or adjusted under 35 U.S.C. 154(b) by 22 days.

(21) Appl. No.: 17/975,172

(22) Filed: Oct. 27, 2022

(65) Prior Publication Data

US 2024/0142184 A1 May 2, 2024

(51) Int. Cl.
*F28F 13/18* (2006.01)
*F28F 13/00* (2006.01)

(52) U.S. Cl.
CPC ..... *F28F 13/18* (2013.01); *F28F 2013/001* (2013.01); *F28F 2245/06* (2013.01)

(58) Field of Classification Search
CPC ... F28F 2013/001; F28F 2245/06; F28F 13/18
See application file for complete search history.

(56) References Cited

U.S. PATENT DOCUMENTS

| | | | | |
|---|---|---|---|---|
| 8,344,597 | B2 * | 1/2013 | Sirbuly | B82Y 30/00 136/205 |
| 9,356,238 | B2 | 5/2016 | Norris et al. | |
| 9,413,196 | B2 * | 8/2016 | Lee | H02J 50/402 |
| 9,691,920 | B2 | 7/2017 | Casse | |
| 2010/0203454 | A1 * | 8/2010 | Brongersma | C23C 14/0688 430/311 |
| 2017/0219746 | A1 | 8/2017 | Nagao et al. | |
| 2017/0227797 | A1 * | 8/2017 | Long | G02F 1/292 |
| 2020/0174287 | A1 * | 6/2020 | Lam | G02B 1/002 |
| 2021/0283569 | A1 * | 9/2021 | Dede | H05B 3/48 |

(Continued)

OTHER PUBLICATIONS

"Thermal radiative properties of metamaterials and other nanostructured materials: A review", Ceji Fu & Zhuomin M. Zhang, 2009 (Year: 2009).*

(Continued)

*Primary Examiner* — Paul Alvare
(74) *Attorney, Agent, or Firm* — Christopher G. Darrow; DARROW MUSTAFA PC

(57) ABSTRACT

A multi-mode heat transfer system includes an emitter device with an inner core surrounded by an outer core having an outer surface and an emission surface disposed on the outer surface. The emission surface includes a thermal metamaterial configured to direct heat from the inner core in at least two desired directions to an object other than the emitter device. The object can include a thermal receiver devices, for example two receiver devices and the emission surface can direct heat to two different receiver devices spaced apart from the emitter device.

20 Claims, 3 Drawing Sheets

(56) References Cited

U.S. PATENT DOCUMENTS

2021/0285735 A1 9/2021 Dede et al.

OTHER PUBLICATIONS

"Thermophotovoltaic emitters based on a two-dimensional grating/thin-film nanostructure", Bo Zhao a, Liping Wang a b, Yong Shuai a c, Zhuomin M. Zhang, 2013 (Year: 2013).*

Sai et al. "Thermophotovoltaic generation with selective radiators based on tungsten surface gratings", Appl. Phys. Lett. 85, Oct. 22, 2004, 4 pages.

Arnold et al. "Coherent thermal infrared emission by two-dimensional silicon carbide gratings", Physical Review B, vol. 86, issue 3, Jul. 15, 2012, 6 pages.

Chen et al. "Design of tungsten complex gratings for thermophotovoltaic radiators", Aug. 16, 2006, 7 pages.

Dede et al., "Thermal metamaterials for radiative plus conductive heat flow," Appl. Phys. Lett. 116, 2020, pp. 1-5.

Gentllon et al., "A comprehensive experimental characterisation of a novel porous media combustion-based thermophotovoltaic system with controlled emission," Applied Energy, vol. 254, Nov. 15, 2019, pp. 1-13.

* cited by examiner

THERMAL METAMATERIALS FOR DIRECTIONAL EMISSION IN HEAT TRANSFER SYSTEMS

TECHNICAL FIELD

The present disclosure generally relates to heat transfer systems and, more specifically, to directing radiate heat from one object to other objects in heat transfer systems.

BACKGROUND

Multi-mode heat transfer systems generally use heat conduction and/or heat radiation to transfer heat from a heat source to one or more heat receiver devices positioned near the heat source. However, including a sufficient number of heat receiving devices to receive a desired percentage of heat from a heat source can require complicated designs and manufacturing.

The present disclosure addresses issues with heat transfer systems, and other issues related to transferring heat from a heat source to one or more objects.

SUMMARY

In one form of the present disclosure, a multi-mode heat transfer system includes an emitter device with an inner core surrounded by an outer core having an outer surface and at least one emission surface disposed on the outer surface. Also, the at least one emission surface includes a thermal metamaterial configured to direct heat from the inner core in a desired direction to an object other than the emitter device.

In another form of the present disclosure, a multi-mode heat transfer system includes an emitter device with an inner core surrounded by an outer core having an outer surface, at least one emission surface in the form of a thermal metamaterial disposed on the outer surface, and at least two receiver devices spaced apart from the emitter device. In addition, the thermal metamaterial is configured to direct heat from the inner core in at least two different desired directions to the at least two receiver devices.

In still another form of the present disclosure, a multi-mode heat transfer system includes an emitter device with an inner core surrounded by an outer core having an outer surface, at least one planar emission surface in the form of a thermal metamaterial disposed on the outer surface, and at least two receiver devices spaced apart from the emitter device. And the thermal metamaterial is configured to direct heat from the inner core at a first angle $+\theta$ relative to a normal of the planar emission surface to one of the at least two receiver devices and a second angle $-\theta$ relative to the normal of the planar emission surface to another of the at least two receiver devices.

These and other features of the multi-mode heat transfer system will become apparent from the following detailed description when read in conjunction with the figures and examples, which are exemplary, not limiting.

BRIEF DESCRIPTION OF THE DRAWINGS

The present teachings will become more fully understood from the detailed description and the accompanying drawings, wherein.

It should be noted that the figures set forth herein are intended to exemplify the general characteristics of the multi-mode heat transfer system of the present technology, for the purpose of the description of certain aspects. The figures may not precisely reflect the characteristics of any given aspect and are not necessarily intended to define or limit specific forms or variations within the scope of this technology.

DETAILED DESCRIPTION

The present disclosure provides multi-mode heat transfer systems and grating structures with thermal metamaterials for multi-mode heat transfer systems. The grating structures direct heat from a heat source in a predefined direction such that the heat is more efficiently provided to a heat receiver device. As used herein, the phrase "direct heat" refers to controlling, steering, or bending thermal radiation such that the thermal radiation propagates along a desired path or direction. Accordingly, the grating structures and/or multi-mode heat transfer systems according to the teachings of the present disclosure provide enhanced efficiency and/or reduced design complexity than traditional multi-mode heat transfer systems.

Figure 1A:
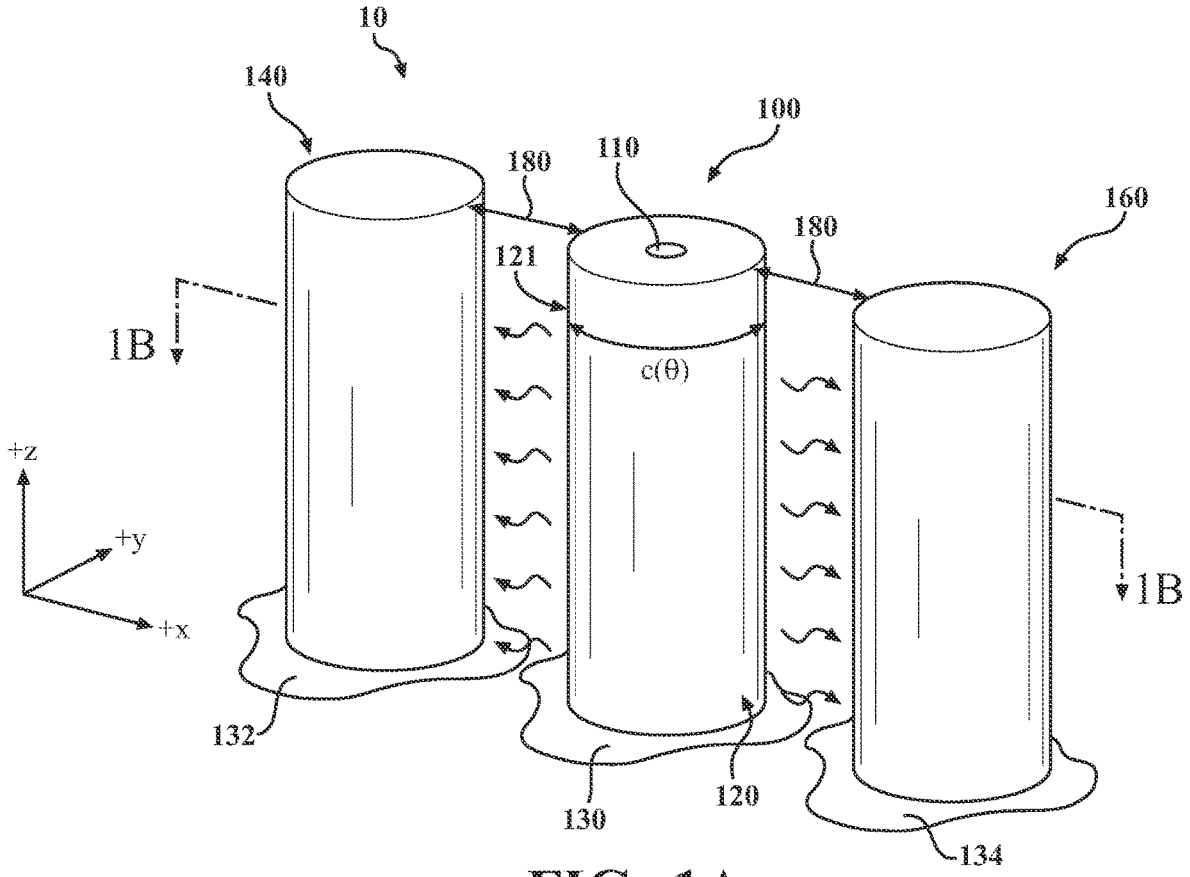
FIG. 1A illustrates a perspective view of a traditional multi-mode heat transfer system.
Figure 1B:
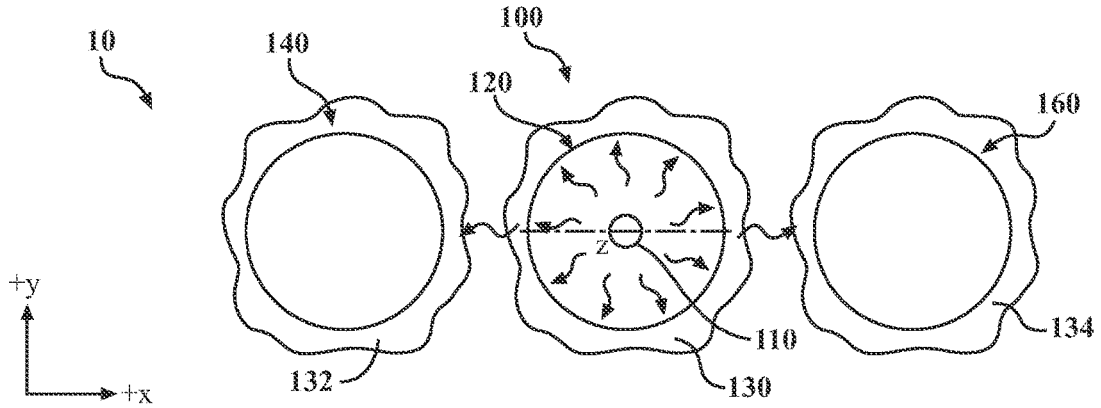
FIG. 1B illustrates a top view of the multi-mode heat transfer system in FIG. 1A.

Referring to FIGS. 1A-1B, a traditional multi-mode heat transfer system 10 is shown. The multi-mode heat transfer system 10 (also referred to herein simply as "heat transfer system") includes a thermal radiation emitter device 100 (also referred to herein simply as "emitter device") and at least one thermal radiation receiver device 140 (also referred to herein simply as "receiver device"). In some variations, the at least one receiver device 140 is a first receiver device 140 and a second receiver 160 is included in the heat transfer system 10. In at least one variation, the emitter device 100 is thermally coupled to a heat source 130, the first receiver device 140 is thermally coupled to a first cooling structure 132 (e.g., a heat sink, an air blower, among others), and/or the second receiver device 160 is thermally coupled to a second cooling structure 134.

The emitter device 100 is positioned to selectively transmit thermal radiation across a gap 180 towards the first receiver device 140 and/or the second receiver device 160. Also, the first receiver device 140 and/or the second receiver device 160 has a reduced temperature (i.e., is colder) than the emitter device 100. Accordingly, the heat transfer system 10, and other heat transfer systems disclosed herein, transfer and direct heat from an emitter device to an area (or volume) where the heat may be beneficial and/or may not cause harm. For example, a heat generated by a hot body engine may be directed, by an emitter device, to one or more receiver devices positioned in an engine compartment area that has ample intake of air to cool the heat. In another example, heat generated by a component in an aerospace application, such as a hot body solar receiver, may be directed, by an emitter device, to one or more receiver devices, such as a sail coupled to another component (e.g., a fly-by-light sailcraft) that requires or works more efficiently when receiving heat and associated directed radiated power.

In some variations, the emitter device 100 is generally cylindrical in shape as shown in FIGS. 1A-1B and has an outer core 120 that circumferentially surrounds an inner core 110. However, in other variations, the emitter device 100 can have other shapes such as a rectangular shape, square shape, hexagonal shape, and a non-regular geometry shape, among others. In at least one variation the outer core 120 is formed from a plurality of radial plus annular, or otherwise custom designed layers that include alternating materials between a high thermal conductivity material inlay and a low thermal conductivity material matrix that circumferentially surround the inner core as disclosed in U.S. Pat. App. Pub. No. 2021/0285735 which is incorporated herein in its entirety by reference. For example, in some variations the high thermal conductivity material inlay is formed from materials such as a graphite composite and metallic materials such as copper, titanium, aluminum, silver, gold, and alloys thereof. In addition, in some variations the low thermal conductivity material matrix is formed from material such as carbon aerogel or polydimethylsiloxane (PDMS) material. Accordingly, the outer core 120 can have or exhibit an anisotropic thermal conductivity that directs heat from the inner core 110 to one or more desired locations on an outer surface 121 of the outer core 120.

Figure 2A:
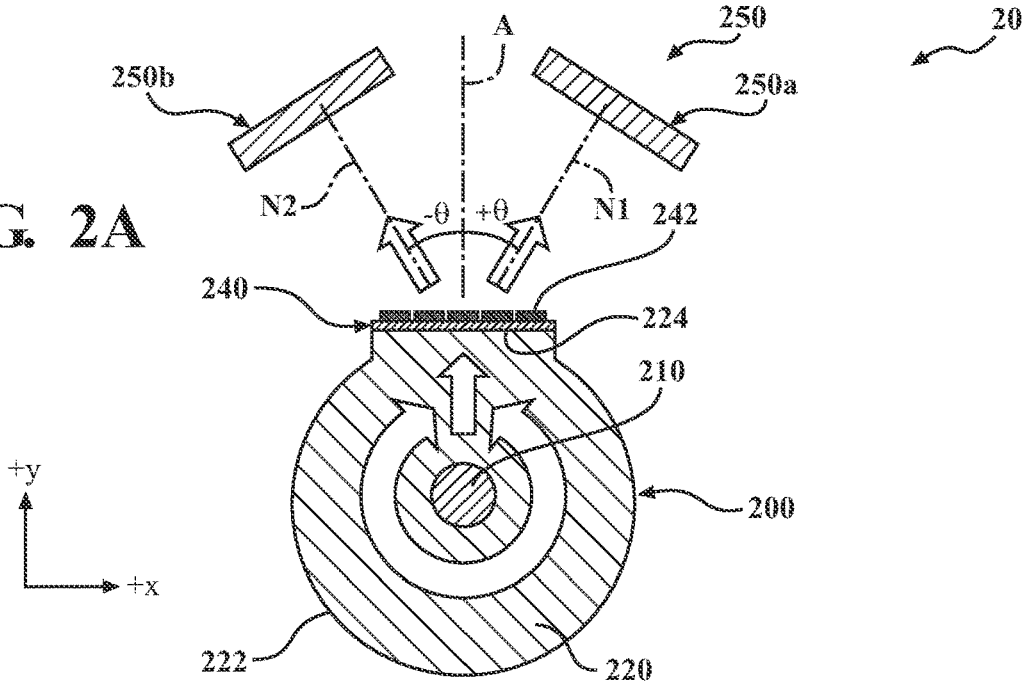
FIG. 2A illustrates a top view of a multi-mode heat transfer system according to one form of the present disclosure.
Figure 2B:
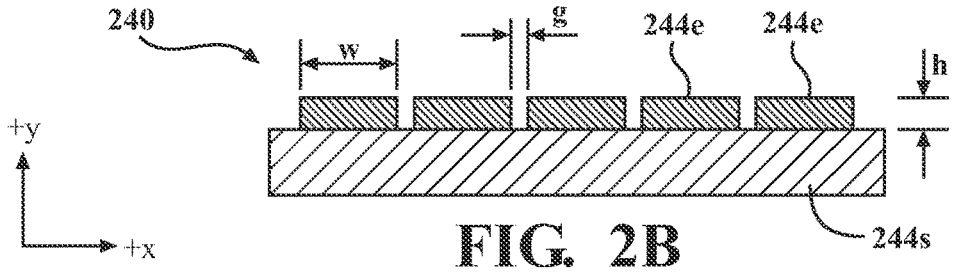
FIG. 2B illustrates a grating structure with a thermal metamaterial according to the teachings of the present disclosure.

Referring now to FIGS. 2A-2B, a multi-mode heat transfer system 20 according to one form of the present disclosure is shown. The heat transfer system 20 includes an emitter device 200 with an inner core 210 and an outer core 220 surrounding the inner core 210, and at least two receiver devices 250. The emitter device 200 is generally cylindrical in shape as shown in FIG. 2A. However, in other variations, the emitter device 200 can have other shapes such as a rectangular shape, square shape, hexagonal shape, and a non-regular geometry shape, among others. And in at least one variation the outer core 220 is formed from a plurality of radial plus annular, or otherwise custom designed layers that include alternating materials between a high thermal conductivity material inlay and a low thermal conductivity material matrix that circumferentially surround the inner core as disclosed in U.S. Pat. App. Pub. No. 2021/0285735. Accordingly, the outer core 220 directs heat from the inner core 210 to at least one desired location 224 on an outer surface 222 of the outer core 220.

Still referring to FIGS. 2A-2B, an outward facing (+y direction) emission surface 240 is positioned at the desired location 224. The emission surface 240 includes a grating structure 242 in the form of a thermal metamaterial configured to direct heat (thermal radiation) received from the inner core 210 in a desired direction. For example, in at least one variation the grating structure 242 includes a substrate 244*s* with a plurality of metamaterial elements 244*e* (also referred to herein simply as "elements") disposed thereon. The elements 244*e* each have a width dimension 'w', a height dimension 'h', and length direction (z direction, not shown). Also, the elements 244*e* include a gap dimension 'g' therebetween and a periodicity 'p' equal to w+g (i.e., p=w+g) in the x direction shown in the figures. In some variations, the grating structure 242 is periodic, while in other variations the grating structure 242 is aperiodic. And in at least one variation, one or more of the elements 244*e* have a different height dimension h compared to one or more other elements 244*e*. In addition, one or more of the elements 244*e* can be formed from a plurality of layers and the plurality of layers may or may not be the same material. Stated differently, one or more of the elements 244*e* can be formed from a plurality of different material layers.

As used herein, the phrase "thermal metamaterial" refers to a material engineered to have a property not found in naturally occurring materials. In addition, the thermal metamaterial includes an assembly or array of multiple elements with dimensions that are less than wavelengths of thermal radiation emitted by the emission surface 240 such that the thermal radiation is steered (also known as being "bent") in or directed to, or in, one or more desired directions.

In some variations the substrate 244*s* and the elements 244*e* are formed from the same material, while in other variations the substrate 244*s* and the elements 244*e* are formed from different materials. For example, in at least one variation the substrate 244*s* is formed from a high temperature ceramic such as silicon carbide (melting point=2730° C.) and the elements 244*e* are formed from a high temperature metallic material such as tungsten (melting point=3422° C.). And in some variations, the elements 244*e* are formed from a material with an extinction coefficient that is greater than an extinction coefficient of the substrate 244*s*. For example, silicon carbide has an extinction coefficient of about 0.0 for a radiation wavelength equal to 632.8 nanometers (nm) while tungsten has an extinction coefficient of about 2.9 for the same radiation wavelength. As used herein, the phrase "extinction coefficient" refers to the intrinsic property of a material that determines how strong the material absorbs or reflects radiation at a particular wavelength. Accordingly, the elements 244*e* formed from tungsten exhibit stronger absorption and thus enhanced emission (due to negligible transmission because of the absorption) of thermal radiation compared to the substrate 244*s* formed from silicon carbide.

In some variations, the grating structure 242 is configured to directed emitted thermal radiation in two or more different directions (i.e., at two or more different angles). For example, and with reference to FIG. 2A, in at least one variation the grating structure 242 includes a substrate 244*s* with an outward (+y direction) planar surface and the thermal metamaterial is configured to emit thermal radiation at an angle +θ and an angle −θ relative to an axis 'A' that is normal to the planar substrate 244*s* (FIG. 2B). In addition, the heat transfer system 20 can include a first receiver device 250*a* with an axis N1 (e.g., an axis normal to an inward facing planar surface of the first receiver device 250*a*) aligned along angle +θ and a second receiver device 250*b* with an axis N2 (e.g., an axis normal to an inward facing planar surface of the second receiver device 250*b*) aligned along angle −θ. And in such variations the first and second receiver devices 250*a*, 250*b* are spaced apart from the emitter device 200 and positioned relative to the grating structure 242 such that enhanced emission (e.g., focused emission) of thermal radiation by the emission surface 240 is received by the first and second receiver devices 250*a*, 250*b*.

It should be understood that the first and second receiver devices 250*a*, 250*b* can be made of high-temperature applicable materials similar to the emission surface 240, but with a surface engineered to enhance absorption of thermal radiation rather than emission thereof. In addition, a grating structure similar to the grating structure 242 can be applied on an outer surface of the first and second receiver devices

250*a*, 250*b*, but a structure and/or dimensions designed to predominately absorb incoming thermal radiation normal to the surface.

Figure 3:
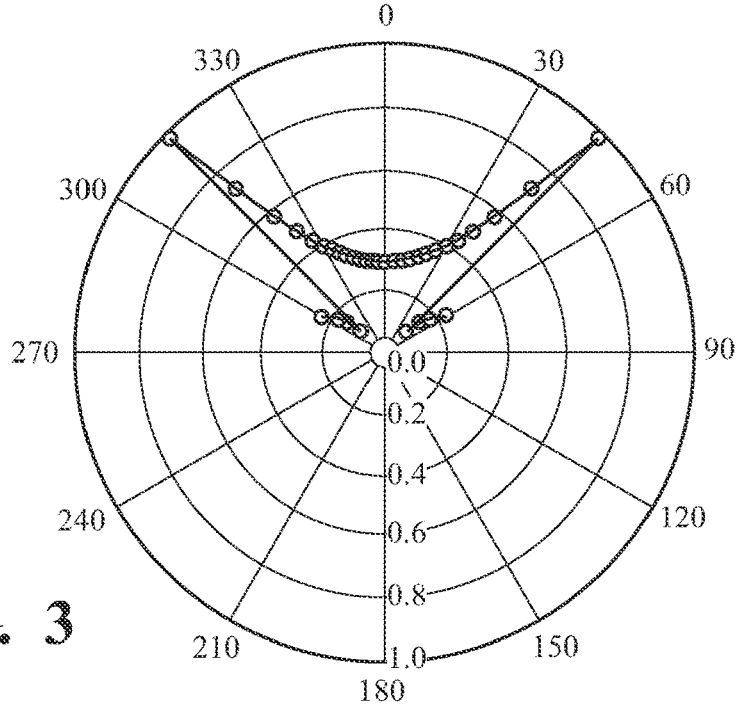
FIG. 3 is a graphical plot of angular-dependent emissivity for a grating structure according to the teachings of the present disclosure.

Referring to FIG. 3, a plot of calculated emissivity for one variation of the grating structure 242 is shown. The grating structure 242 was designed to exhibit peak emission at $+\theta=+45°$ and $-\theta=-45°$ for thermal radiation with a wavelength equal to about 1086 nm. However, it should be understood that the grating structure 242 can be designed and fabricated such that peak emission can occur at different absolute value angles, e.g., +45° and −30°. In the alternative, or in addition to, the grating structure 242 can be designed and fabricated such that a broad-angle lobe emission is provided.

Still referring to FIG. 3, calculated emissivity assumed the substrate 244*s* was formed from silicon carbide and the elements 244*e* were formed from tungsten. In addition, the width dimension w was equal to 5 μm, the height dimension h was equal to 284 μm, and the gap g was equal to 1.248 μm. And as observed from the plot in FIG. 3, two sharp emission peaks exceeding 0.95 are observed at −45° and +45°, and the emission drops below 0.4 within about +/−15° from −45° and +45°.

Figure 4:
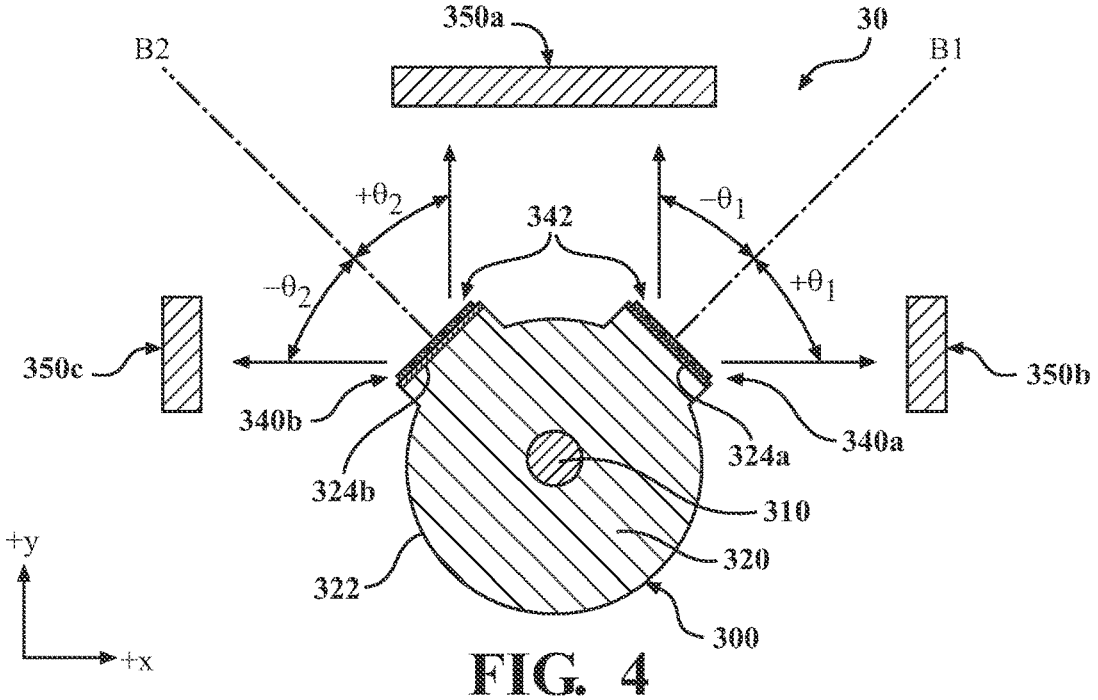
FIG. 4 illustrates a top view of a multi-mode heat transfer system according to another form of the present disclosure.

Referring to FIG. 4, a heat transfer system 30 according to another form of the present disclosure is shown. The heat transfer system 30 includes an emitter device 300 with an inner core 310, an outer core 320 surrounding the inner core 310, a first emission surface 340*a* and a second emission surface 340*b*. The emitter device 300 is generally cylindrical in shape as shown in FIG. 4. However, in other variations, the emitter device 300 can have other shapes such as a rectangular shape, square shape, hexagonal shape, and a non-regular geometry shape, among others. And in at least one variation the outer core 320 is formed from a plurality of radial plus annular, or otherwise custom designed layers that include alternating materials between a high thermal conductivity material inlay and a low thermal conductivity material matrix that circumferentially surround the inner core as disclosed in U.S. Pat. App. Pub. No. 2021/0285735. Accordingly, the outer core 320 directs heat from the inner core 310 to the two desired locations 324*a*, 324*b* on an outer surface 322 of the outer core 320.

The first emission surface 340*a* and the second emission surface 340*b* each include a grating structure 342 in the form of a thermal metamaterial configured to direct heat received from the inner core 310 in at least one desired direction. For example, in at least one variation the grating structure 342 includes a substrate 244*s* (FIG. 2B) with a plurality of elements 244*e* (FIG. 2B) disposed thereon. In addition, the elements 244*e* each have a width dimension 'w', a height dimension 'h', and length direction (z direction, not shown). Also, the elements 244*e* include a gap 'g' therebetween, and the first emission surface 340*a* and the second emission surface 340*b* are configured to direct emitted thermal radiation at angles $+\theta_1$, and $-\theta_1$, and $+\theta_2$ and $-\theta_2$, respectively. In some variations, the absolute value of $+\theta_1$, is equal to the absolute value of $-\theta_1$, and/or the absolute value of $+\theta_2$ is equal to the absolute value of $-\theta_2$. While in other variations, the absolute value of $+\theta_1$, is not equal to the absolute value of $-\theta_1$, and/or the absolute value of $+\theta_2$ is not equal to the absolute value of $-\theta_2$. Stated differently, the subscript for a given angle $\theta_i$ corresponds to a particular emission surface 340*a*, 340*b*, and other emission surfaces disclosed herein, and not necessarily to a particular angle value.

The heat transfer system 30 also includes three receiver devices 350, particularly, a first receiver device 350*a*, a second receiver device 350*b*, and a third receiver device 350*c*. The first receiver device 350*a* is positioned or aligned to receive thermal radiation emitted from the first emission surface 340*a* and directed at the angle $-\theta_1$, relative to the axis $B_1$ (e.g., an axis normal to a planar surface of the first emission surface 340*a*), and thermal radiation from the second emission surface 340*b* and directed at the angle $+\theta_2$ relative to the axis B2 (e.g., an axis normal to a planar surface of the second emission surface 340*b*). The second receiver device 350*b* is positioned or aligned to receive thermal radiation emitted from the first emission surface 340*a* and directed at the angle $+\theta_1$ relative to the axis $B_1$. And the third receiver device 350*c* is positioned or aligned to receive thermal radiation emitted from the second emission surface 340*b* and directed at the angle $-\theta_2$ relative to the axis $B_2$.

In some variations, and as illustrated in FIG. 4, the second receiver device 350*b* and the third receiver device 350*c* receive directed thermal radiation from only one emission surface and are smaller or more compact than the first receiver device 350*a* that receives thermal radiation from the first emission surface 340*a* and the second emission surface 340*b*. Accordingly, the heat transfer systems and/or grading structures according to the teachings of the present disclosure provide for efficient design and/or use of multiple receiver devices.

Figure 5:
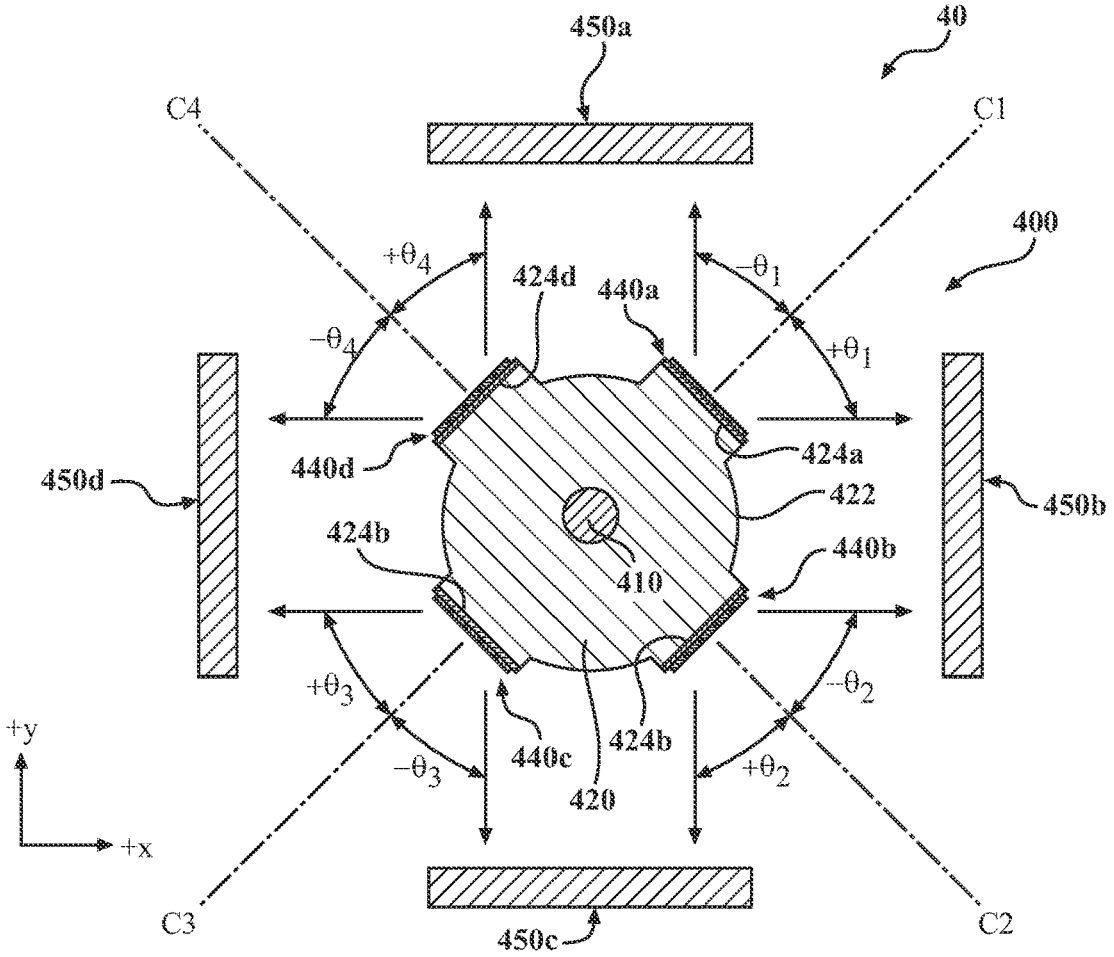
FIG. 5 illustrates a top view of a multi-mode heat transfer system according to still another form of the present disclosure.

Referring now to FIG. 5, a heat transfer system 40 according to still another form of the present disclosure is shown. The heat transfer system 40 includes an emitter device 400 with an inner core 410, an outer core 420 surrounding the inner core 410, a first emission surface 440*a*, a second emission surface 440*b*, a third emission surface 440*c*, and a fourth emission surface 440*d*. The emitter device 400 is generally cylindrical in shape as shown in FIG. 5. However, in other variations, the emitter device 400 can have other shapes such as a rectangular shape, square shape, hexagonal shape, and a non-regular geometry shape, among others. And in at least one variation the outer core 420 is formed from a plurality of radial plus annular, or otherwise custom designed layers that include alternating materials between a high thermal conductivity material inlay and a low thermal conductivity material matrix that circumferentially surround the inner core as disclosed in U.S. Pat. App. Pub. No. 2021/0285735. Accordingly, the outer core 420 directs heat from the inner core 410 to the four desired locations 424*a*, 424*b*, 424*c*, 424*d* on an outer surface 422 of the outer core 420.

The first, second, third, and fourth emission surfaces 440*a*, 440*b*, 440*c*, 440*d* each have a grating structure (not labeled) in the form of a thermal metamaterial configured to direct heat received from the inner core 410 in at least one desired direction. For example, in at least one variation the grating structure includes a substrate 244*s* with a plurality of elements 244*e* (FIG. 2B) disposed thereon. In addition, the elements 244*e* each have a width dimension 'w', a height dimension 'h', and length direction (z direction, not shown), and the elements 244*e* include a gap 'g' therebetween, and the emission surfaces 440*a*, 440*b*, 440*c*, 440*d*, are configured to direct emitted thermal radiation at angles $+\theta_1$ and $-\theta_1$, $+\theta_2$ and $-\theta_2$, $+\theta_3$ and $-\theta_3$, and $+\theta_4$ and $-\theta_4$, respectively, relative to axes $C_1$, $C_2$, $C_3$, $C_4$, shown in FIG. 5. In some variations, the absolute value of $+\theta_1$ is equal to the absolute value of $-\theta_1$, the absolute value of $+\theta_2$ is equal to the absolute value of $-\theta_2$, the absolute value of $+\theta_3$ is equal to the absolute value of $-\theta_3$, and/or the absolute value of $+\theta_4$ is equal to the absolute value of $-\theta_4$. While in other variations, the absolute value of $+\theta_1$ is not equal to the absolute value of $-\theta_1$, the absolute value of $+\theta_2$ is not equal to the absolute value of $-\theta_2$, the absolute value of $+\theta_3$ is not equal to the absolute value of $-\theta_3$, and/or the absolute value of $+\theta_4$ is not equal to the absolute value of $-\theta_4$.

The heat transfer system 40 also includes four receiver devices 450, particularly, a first receiver device 450*a*, a second receiver device 450*b*, a third receiver device 450*c*, and a fourth receiver device 450*d*. The first receiver device 450*a* is positioned or aligned to receive thermal radiation emitted from the first emission surface 440*a* directed at the angle $-\theta_1$ relative to axis $C_1$ and thermal radiation emitted from the fourth emission surface 440*d* at the angle $+\theta_4$ relative to axis $C_4$. The second receiver device 450*b* is positioned or aligned to receive thermal radiation emitted from the first emission surface 440*a* directed at the angle $+\theta_1$ relative to axis $C_1$ and thermal radiation emitted from the second emission surface 440*b* at the angle $-\theta_2$ relative to axis $C_2$. The third receiver device 450*c* is positioned or aligned to receive thermal radiation emitted from the second emission surface 440*b* directed at the angle $+\theta_2$ relative to axis $C_2$ and thermal radiation emitted from the third emission surface 440*c* at the angle $-\theta_3$ relative to axis $C_3$. And the fourth receiver device 450*d* is positioned or aligned to receive thermal radiation emitted from the third emission surface 440*c* directed at the angle $+\theta_3$ relative to axis $C_3$ and thermal radiation emitted from the fourth emission surface 440*d* at the angle $-\theta_4$ relative to axis $C_4$.

Accordingly, heat transfer systems with emitter devices with grating structures in the form of thermal metamaterials according to the teachings of the present disclosure provide enhanced heat transfer by directing heat from a heat source in a desired focused direction towards a heat receiving device. In addition, the emitter devices according to the teachings of the present disclosure direct heat in at least two different focused directions such that at least two different receiver devices can receive heat from a single emitter device.

The preceding description is merely illustrative in nature and is in no way intended to limit the disclosure, its application, or uses. As used herein, the phrase at least one of A, B, and C should be construed to mean a logical (A or B or C), using a non-exclusive logical "or." It should be understood that the various steps within a method may be executed in different order without altering the principles of the present disclosure. Disclosure of ranges includes disclosure of all ranges and subdivided ranges within the entire range.

The headings (such as "Background" and "Summary") and sub-headings used herein are intended only for general organization of topics within the present disclosure and are not intended to limit the disclosure of the technology or any aspect thereof. The recitation of multiple forms or variations having stated features is not intended to exclude other forms or variations having additional features, or other forms or variations incorporating different combinations of the stated features.

As used herein the terms "about" and "generally" when related to numerical values herein refers to known commercial and/or experimental measurement variations or tolerances for the referenced quantity. In some variations, such known commercial and/or experimental measurement tolerances are +/−10% of the measured value, while in other variations such known commercial and/or experimental measurement tolerances are +/−5% of the measured value, while in still other variations such known commercial and/or experimental measurement tolerances are +/−2.5% of the measured value. And in at least one variation, such known commercial and/or experimental measurement tolerances are +/−1% of the measured value.

As used herein, the terms "comprise" and "include" and their variants are intended to be non-limiting, such that recitation of items in succession or a list is not to the exclusion of other like items that may also be useful in the devices and methods of this technology. Similarly, the terms "can" and "may" and their variants are intended to be non-limiting, such that recitation that a form or variation can or may comprise certain elements or features does not exclude other forms or variations of the present technology that do not contain those elements or features.

The broad teachings of the present disclosure can be implemented in a variety of forms. Therefore, while this disclosure includes particular examples, the true scope of the disclosure should not be so limited since other modifications will become apparent to the skilled practitioner upon a study of the specification and the following claims. Reference herein to one aspect, or various aspects means that a particular feature, structure, or characteristic described in connection with a form or variation is included in at least one form or variation. The appearances of the phrase "in one variation" or "in one form" (or variations thereof) are not necessarily referring to the same form or variation. It should be also understood that the various method steps discussed herein do not have to be carried out in the same order as depicted, and not each method step is required in each form or variation.

The foregoing description of the forms or variations has been provided for purposes of illustration and description. It is not intended to be exhaustive or to limit the disclosure. Individual elements or features of a particular form or variation are generally not limited to that particular form or variation, but, where applicable, are interchangeable and can be used in a selected form or variation, even if not specifically shown or described. The same may also be varied in many ways. Such variations should not be regarded as a departure from the disclosure, and all such modifications are intended to be included within the scope of the disclosure.

While particular forms or variations have been described, alternatives, modifications, variations, improvements, and substantial equivalents that are or may be presently unforeseen may arise to applicants or others skilled in the art. Accordingly, the appended claims as filed and as they may be amended, are intended to embrace all such alternatives, modifications variations, improvements, and substantial equivalents.

What is claimed is:

1. A multi-mode heat transfer system comprising:

an emitter device comprising an inner core surrounded by an outer core having an outer surface; and at least one emission surface disposed on the outer surface, the at least one emission surface comprising a grating structure with a plurality of tungsten containing metamaterial elements on a silicon carbide containing substrate, the at least one emission surface configured to direct heat from the inner core in a desired direction to an object other than the emitter device.

2. The multi-mode heat transfer system according to claim 1, wherein the plurality of tungsten containing metamaterial elements have a width dimension 'w', a height dimension 'h', are spaced apart from each other by a gap dimension 'g', and have a periodicity on the silicon carbide containing substrate equal to w+g.

3. The multi-mode heat transfer system according to claim 1, wherein the silicon carbide containing substrate is a planar substrate.

4. The multi-mode heat transfer system according to claim 3, wherein the grating structure is configured to direct heat from the inner core at angle θ relative to a normal to the planar substrate, the angle θ not being equal to zero.

5. The multi-mode heat transfer system according to claim 4, wherein the grating structure is configured to direct heat from the inner core at a first angle $+\theta_1$ and a second angle $-\theta_1$ relative to the normal to the planar substrate.

6. The multi-mode heat transfer system according to claim 5, wherein the object comprises a first receiver device and a second receiver device spaced apart from the first receiver device, and the grating structure is configured to direct heat at the first angle $+\theta_1$ to the first receiver device and configured to direct heat at the second angle $-\theta_1$ to the second receiver device.

7. The multi-mode heat transfer system according to claim 1, wherein the at least one emission surface comprises at least two emission surfaces with a grating structure comprising the plurality of tungsten containing metamaterial elements disposed on the silicon carbide containing substrate, each of the grating structures configured to direct heat from the inner core to at least two different spaced apart objects other than the emitter device.

8. The multi-mode heat transfer system according to claim 7, wherein the at least two emission surfaces comprise a first emission surface and a second emission surface different than the first emission surface, the first emission surface configured to direct heat from the inner core to a first receiver device and a second receiver device spaced apart from the first receiver device, and the second emission surface configured to direct heat from the inner core to the second receiver device and a third receiver device different than the second receiver device and the first receiver device.

9. The multi-mode heat transfer system according to claim 1, wherein:

the at least one emission surface comprises a first emission surface, a second emission surface oriented 90° relative to the first emission surface, a third emission surface oriented 180° relative to the first emission surface, and a fourth emission surface oriented 270° degrees relative to the first emission surface; and the object comprises a first receiver device, a second receiver device oriented 90° from the first receiver device, a third receiver device oriented 180° from the first receiver device, and a fourth receiver device oriented 270° from the first receiver device.

10. The multi-mode heat transfer system according to claim 9, wherein the first emission surface, the second emission surface, the third emission surface, and the fourth emission surface each direct heat from the inner core to two receiver devices spaced apart from each other.

11. The multi-mode heat transfer system according to claim 9, wherein:

the first emission surface directs heat from the inner core to the first receiver device and the second receiver device;

the second emission surface directs heat from the inner core to the second receiver device and the third receiver device;

the third emission surface directs heat from the inner core to the third receiver device and the fourth receiver device; and the fourth emission surface directs heat from the inner core to the fourth receiver device and the first receiver device.

12. The multi-mode heat transfer system according to claim 9, wherein:

the first emission surface is oriented 45° relative to the first receiver device and the second receiver device;

the second emission surface is oriented 45° relative to the second receiver device and the third receiver device;

the third emission surface is oriented 45° relative to the third receiver device and the fourth receiver device; and the fourth emission surface is oriented 45° relative to the fourth receiver device and the first receiver device.

13. A multi-mode heat transfer system comprising:

an emitter device comprising an inner core surrounded by an outer core having an outer surface;

at least two emission surfaces with a grating structure comprising a plurality of metamaterial elements disposed on a substrate; and at least two receiver devices spaced apart from the emitter device, wherein the at least two emission surfaces are configured to direct heat from the inner core in at least two different desired directions to the at least two receiver devices.

14. The multi-mode heat transfer system according to claim 13, wherein the plurality of metamaterial elements have a gap dimension 'g', a width dimension 'w', a height dimension 'h', and a periodicity on the substrate equal to w+g.

15. The multi-mode heat transfer system according to claim 14, wherein the substrate comprises silicon carbide and the plurality of metamaterial elements comprise tungsten.

16. A multi-mode heat transfer system comprising:

an emitter device comprising an inner core surrounded by an outer core having an outer surface;

at least one planar emission surface comprising a thermal metamaterial disposed on the outer surface; and at least two receiver devices spaced apart from the emitter device, wherein the thermal metamaterial is configured to direct heat from the inner core at a first angle $+\theta_1$ relative to a normal of the planar emission surface to one of the at least two receiver devices and a second angle $-\theta_1$ relative to the normal of the planar emission surface to another of the at least two receiver devices.

17. The multi-mode heat transfer system according to claim 16, wherein the thermal metamaterial comprises a substrate with a first extinction coefficient and a plurality of metamaterial elements with a second extinction coefficient greater than the first extinction coefficient.

18. The multi-mode heat transfer system according to claim 16, wherein the at least one planar emission surface comprises a grating structure.

19. The multi-mode heat transfer system according to claim 16, wherein the at least one planar emission surface comprises a grating structure with a plurality of metamaterial elements disposed on the outer surface.

20. The multi-mode heat transfer system according to claim 19, wherein the plurality of metamaterial elements comprise tungsten and the outer surface comprises silicon carbide.

* * * * *